United States Patent [19]

Daniels

[11] 4,439,034

[45] Mar. 27, 1984

[54] METHOD AND APPARATUS FOR PURGING A COPIER DEVELOPER

[75] Inventor: Raymond A. Daniels, Thornwood, N.Y.

[73] Assignee: International Business Machines Corporation, Armonk, N.Y.

[21] Appl. No.: 450,958

[22] Filed: Dec. 20, 1982

[51] Int. Cl.[3] ..... G03G 15/09

[52] U.S. Cl. ..... 355/3 DD; 355/14 D; 118/658; 118/652; 430/122

[58] Field of Search ..... 355/3 DD, 14 D, 15, 355/3 R, 14 R, 3 CH; 430/122, 125; 118/657, 658, 640, 652

[56] References Cited

U.S. PATENT DOCUMENTS

| | | | |
|---|---|---|---|
| 3,411,932 | 11/1968 | Malone et al. | 118/652 X |
| 3,590,412 | 7/1971 | Gerbasi | 118/652 X |
| 3,634,077 | 1/1972 | Sullivan | 118/652 X |
| 3,816,157 | 6/1974 | Donohue et al. | 355/15 X |
| 3,927,640 | 12/1975 | Smith | 118/637 |
| 3,969,785 | 7/1976 | Ogawa et al. | 355/15 X |
| 4,351,604 | 9/1982 | Karasawa et al. | 355/3 DD X |

FOREIGN PATENT DOCUMENTS 55-186649 12/1980 Japan .
55-162547 5/1982 Japan .

OTHER PUBLICATIONS

IBM 3800 Model III Printer, Operators's Guide, pp. 4-21-4-22, Jun. 1977.

*Primary Examiner*—A. C. Prescott
*Attorney, Agent, or Firm*—Homer L. Knearl

[57] ABSTRACT

Developer mix is purged from a magnetic brush developer in a xerographic copier or printer by moving the pick-up zone of a magnetic brush roller out of the throw-off zone of a magnetic transport roller. A purge door is located adjacent the throw-off zone. In a purge operation, a catching container is attached to the developer at the purge door. The purge door is opened, and the magnets of the magnetic brush roller are rotated so that the pick-up zone of the brush moves out of the throw-off zone of the transport. The developer is then driven, and the developer mix moves through the developer, out the purge opening and into the catcher.

8 Claims, 4 Drawing Figures

METHOD AND APPARATUS FOR PURGING A COPIER DEVELOPER

FIELD OF THE INVENTION

This invention relates to a xerographic copier or printer. More particularly, the invention relates to cleaning developer mix out of a magnetic brush developer in such a copier or printer.

BACKGROUND OF THE INVENTION

The developer mix in a xerographic copier contains two elements, toner and steel beads. The steel beads act as carrier for the toner so that magnetic transport rollers and magnetic brush rollers can move the toner to the photoconductor. At the photoconductor, some of the toner transfers from the steel beads to the electrostatic image on the photoconductor to develop that image.

As toner is used up in the developing process, additional toner is metered into the developer. After many thousands of copies, the developer mix begins to degrade even though it is being replenished with fresh toner. When this occurs, substantially all of the developer mix must be removed from the developer and replaced with a new developer mix.

Replacing the developer mix has been a time consuming and dirty job. Typically, the entire developer is removed from the machine and held upside-down over a trash container to dump the old developer mix. The customer engineer performing this task must wear gloves or be prepared to have his hands covered by black toner dust. Even if a vacuum cleaner is used on the developer, it is difficult to remove the old mix because the particles in the mix are electro-statically charged.

Another way to purge the developer mix involves exposing the magnetic brush roller, placing a scraper with catcher against the surface of the roller and rotating the magnets within the roller. The magnetic brush is exposed by sliding the developer on rails out the side of the copier. A scraping blade with a catching container is then held against the surface of the magnetic brush roller. A handle for rotating the magnetics about a shaft inside the roller is pulled out and turned by the operator. As the magnets rotate within the roller, the developer mix walks along the surface of the roller and is scraped off into the catching container by the scraping blade.

Yet another technique for purging developer mix consists of opening a front wall of the developer and attaching a catching container to the opening. The catcher has a lever operated deflector. Once the catcher is attached, the lever is rotated so that the deflector enters the developer and moves into the return path for the mix from the magnetic brush to the mixing sump at the bottom of the developer. Now as the developer is operated, the deflector intercepts the mix and deflects it into the catcher.

While the above techniques accomplish the dumping of the developer mix, they still are likely to leave residual mix in the developer and cause some toner contamination of the copier or the operator. In one case, the operator must hold a scraper against the magnetic brush roller and, in the other case, the operator must open up the developer before the catcher is attached.

SUMMARY OF THE INVENTION

In accordance with this invention, the above problems have been solved by repositioning the magnets in the magnetic brush roller during a purge operation so that the magnetic pick-up zone of a brush roller is moved away from the throw-off zone of a transport roller. A purge opening with a door is provided next to the throw-off zone of the transport roller. During the purge operation, a catching container is attached at the opening, the purge door is opened, and the magnetic pick-up zone of the brush roller is moved away from the throw-off zone of the transport roller. When the developer is turned on, substantially all of the developer mix circulates through the developer and is thrown out the purge opening from the throw-off zone of the transport roller.

There are several advantages to this invention. First, there is little or no toner contamination of the operator or the copier because the catching container is attached, before the purge door is opened, and because the catcher and developer are a closed system during the purge operation. Further, the purge operation for the operator is simple and quick. The operator simply attaches the catcher to the purge spout, moves a lever to open the purge door, moves a second lever to move the magnetic pick-up zone of the brush roller away from the throw-off zone of the transport roller and turns the developer on. The developer will purge itself after about a minute of operation. Finally, substantially all of the developer mix is thrown out of the developer during the purge operation.

BRIEF DESCRIPTION OF DRAWINGS

The invention is described in detail below with reference to drawings, illustrating a specific embodiment of the invention, in which.

DETAILED DESCRIPTION

Figure 1:
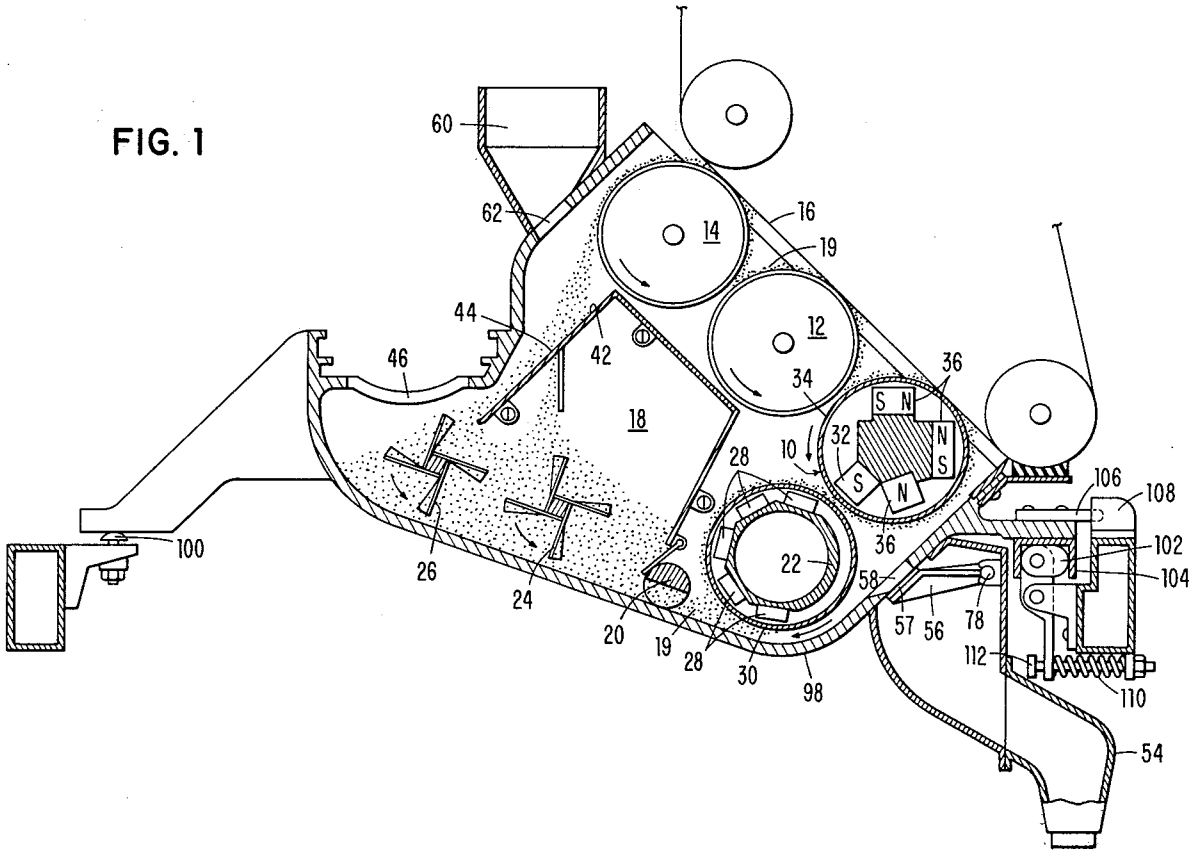
FIG. 1 shows the developer in its normal developing mode of operation.

Referring now to FIG. 1, the developer in the preferred embodiment of the invention utilizes three magnetic brush rolls 10, 12 and 14 to develop an electrostatic image on the belt photoconductor 16. The developer is gated from the mixing chamber 18 within the developer by gate 20 to a transporting magnetic roll 22. The developer mix passes through gate 20 by virtue of gravity and general motion in the mix created by agitators 24 and 26 within the mixing chamber.

After the developer mix leaves gate 20, it is picked up by transport roller 22 by virtue of the magnetic field generated by permanent magnets 28 mounted inside transport roller 22. Magnets 28 are fixed while the transport roll surface 30 rotates clockwise. This carries the developer mix up to the bottom of magnetic brush 10.

At magnetic brush 10 pick-up magnet 32 attracts the developer mix to the surface of brush 10. Surface 34 of brush 10 is rotating counterclockwise. Magnets 32 and 36 in magnetic brush 10 are held in the develop position shown in FIG. 1 during a developing operation. Due to the pattern of magnetic fields generated by magnets 32 and 36 and the rotation of surface 34 of brush 10, developer mix 19 is carried up to the surface of photoconductor 16 and passed to magnetic brush 12.

Magnetic brushes 12 and 14 also contain magnets (not shown) in fixed position and have surfaces that rotate counterclockwise so as to transport the developer mix 19 upward along the path of photoconductor 16. In effect, there are three magnetic brushes developing the electrostatic image on the photoconductor as the photoconductor passes through the developer.

After the developer mix passes the last permanent magnet in magnetic brush 14, it falls towards wall 42 of the mixing chamber 18. Wall 42 contains openings 44 so that a portion of the developer mix falls through into the mixing chamber 18 while the remainder falls toward agitator 26. Above agitator 26, a toner replenisher (not shown) periodically meters additional toner in through opening 46. This toner is mixed with the developer mix in mixing chamber 18 by agitators 26 and 24 which rotate counterclockwise.

Eventually the developer mix, even though replenished with toner through input slot 46, becomes unusable. It is then necessary to replace the entire developer mix.

Figure 2:
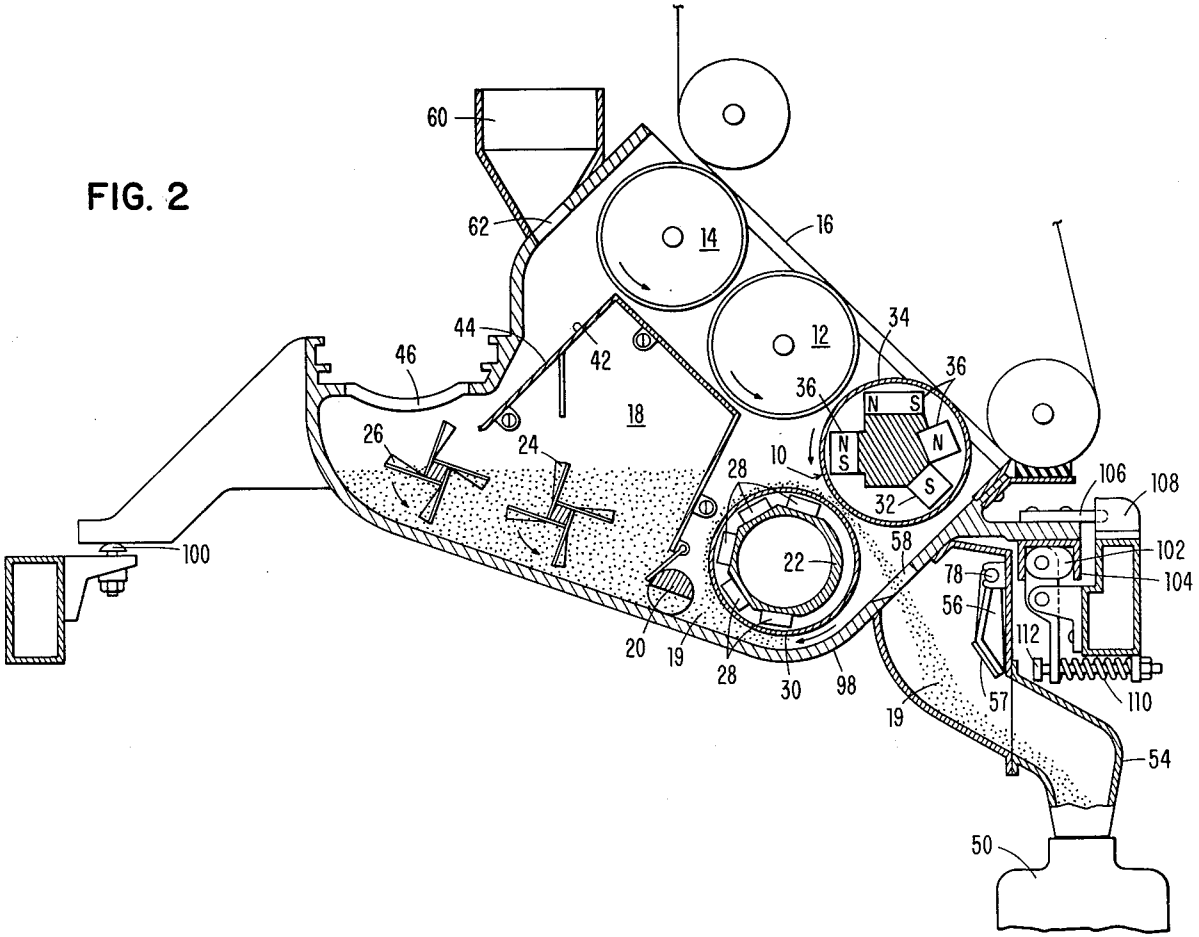
FIG. 2 shows the developer during a purge operation with the pick-up zone of the first brush roller moved away from the throw-off zone of the transport roller so that the developer mix is thrown out the purge opening.

In FIG. 2, the developer is shown as it operates when purging old developer mix from the developer. To accomplish the purge, a catching container 50 outside of the copier is attached to spout 54. Then purge door 56 opposite the throw-off zone of transport roller 22 is opened. Magnets 36 and 32 within magnetic brush 10 are rotated to the purge position so that the pick-up zone produced by the field from magnet 32 is away from the throw-off zone of transport roller 22.

With magnets 32 and 36 positioned as shown in FIG. 2, developer mix 19, as it comes off transport roller 22, is thrown out opening 58 and into spout 54. Developer mix flows or falls out spout 54 into catcher 50. As the developer continues to operate, substantially all of the developer mix will be moved out of the developer and into catcher 50 in a few minutes.

During the purge operation, no new toner is fed in through opening 46. After the purge is completed, purge door 56 is swung counterclockwise to close purge opening 58. The face 57 of door 56 is covered with foam to form a good seal with opening 58. Magnets 32 and 36 are rotated counterclockwise to the develop position as shown in FIG. 1. Catcher 50 is removed from the copier. The developer is now ready for recharge.

To recharge the developer, a new developer mix containing toner and beads is poured in through funnel 60 and enters the developer through opening 62. The developer mix falls down into mixing chamber 18 and circulates around the developer as previously described for FIG. 1.

Figure 3:
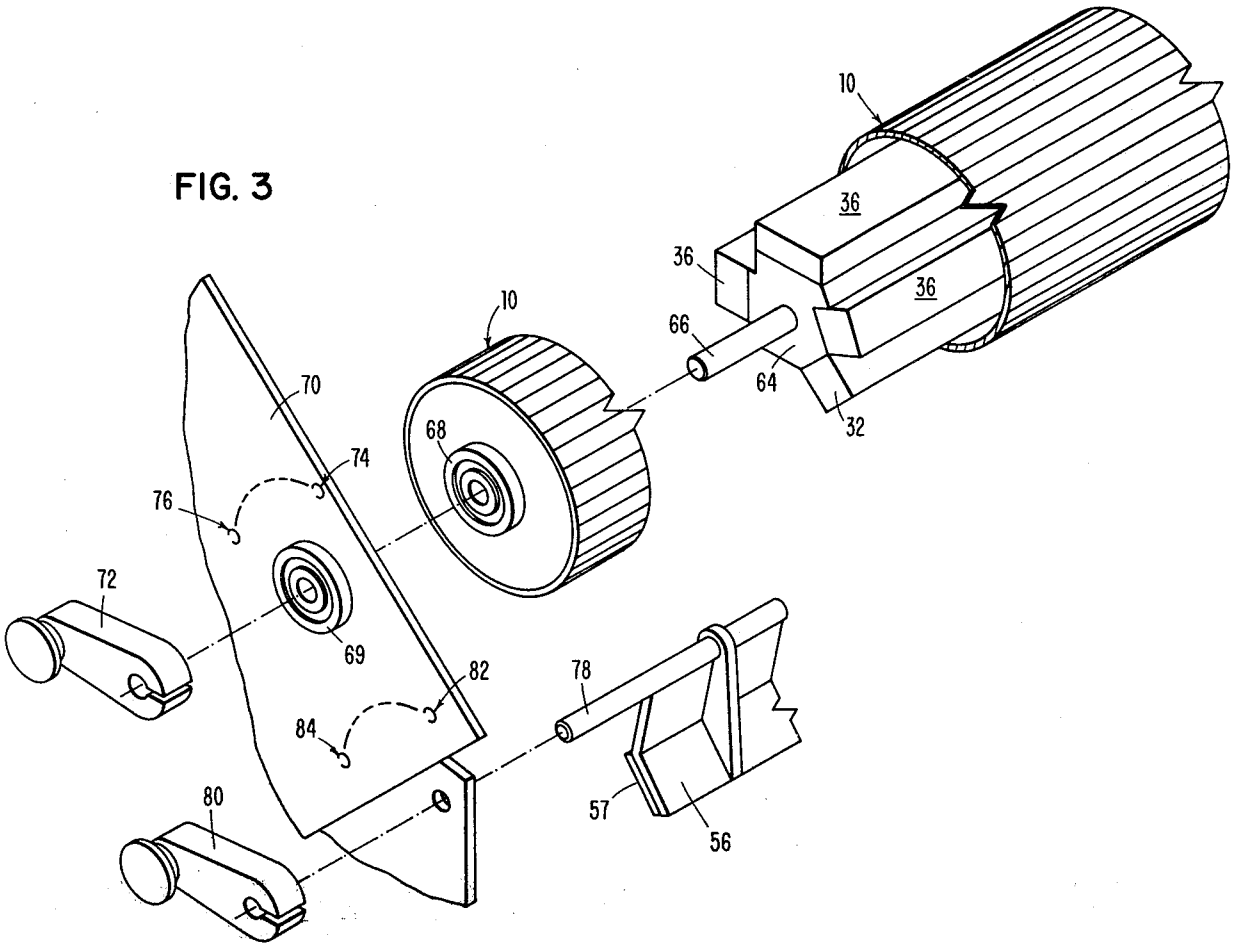
FIG. 3 is an exploded view showing how the zone lever moves the magnets to move the pick-up zone and how the door lever opens and closes the purge door.

Operative levers for moving the magnetic core within roller 10 and for moving the purge door 56 within spout 54 are shown in FIG. 3. The magnetic core consists of magnets 32 and 36 permanently mounted on holder 64 which is press-fit on shaft 66. The shaft passes through the end of the roller 10 in a bearing 68. The shaft then passes through bearing 69, frame 70 of the developer, and lever 72 is attached to the shaft.

Lever 72 contains a spring-loaded pin (not shown). The spring-loaded pin engages a detent 74 to hold the magnets in the develop position, as shown in FIG. 1. The spring-loaded pin engages detent 76 to hold the magnets in the purge position, as shown in FIG. 2.

Purge door 56 is mounted on shaft 78 that extends out the side of the purge spout. Lever 80, attached to shaft 78, contains a spring-loaded pin (not shown) just as lever 72. When door 56 is closed (develop position), the spring-loaded pin engages detent 82. When the purge door is open (purge position), the spring-loaded pin engages detent 84.

Figure 4:
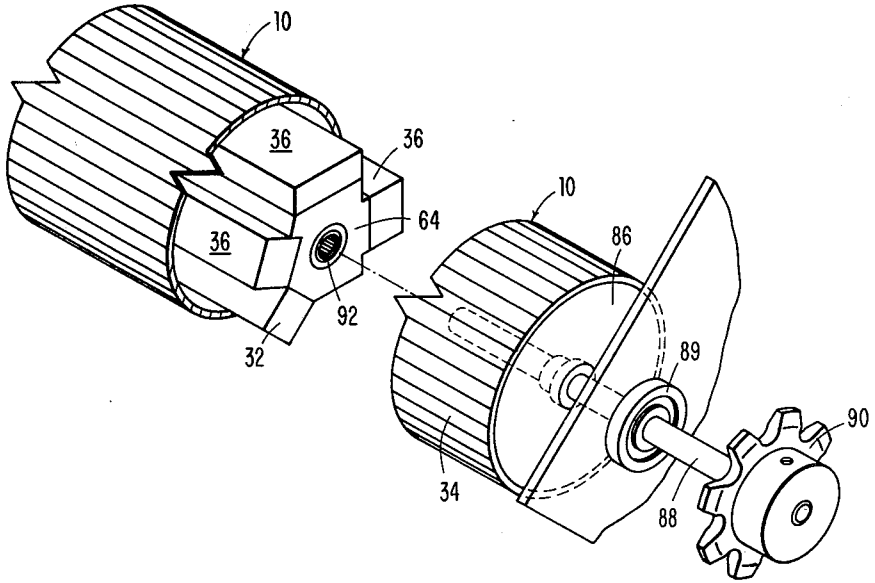
FIG. 4 shows the mounting of the brush roller so that the surface of the roller may be driven.

The drive connection to rotate surface 34 of brush 10 is shown in FIG. 4. Surface 34 is attached to the end cap 86 which is press-fit onto shaft 88. Shaft 88 passes through bearing 89 in the frame of the developer. Drive gear 90 is attached to shaft 88 outside the developer. Shaft 88 is a stub shaft and extends just far enough into the brush 10 to engage bearing 92 which is in the end of holder 64 that holds magnets 32 and 36.

Referring again to FIG. 1, the mounting of the developer in reference to the plane of photoconductor 16 will now be described. The surfaces of magnetic brushes 10, 12 and 14 should be about 0.6 mm from the surface of photoconductor 16. However, when it is necessary to replace the photoconductor belt, it is desirable to move the developer at least 6.0 mm away from photoconductor 16. This is accomplished by translating the developer sideways in FIG. 1. The developer will slide on mounting pins 100 (one shown at the left in FIG. 1) and is moved by cam 102 (at the right in FIG. 1).

Frame 98 of the developer carries a U-shaped channel 104 and two or more reference pins 106. Reference pins 106 engage reference stop 108 which is attached to the frame of the copier and defines the home position for the developer. When pin 106 is pushed up against reference stop 108, then brushes 10, 12 and 14 will be correctly positioned relative to the surface of photoconductor 16.

In the position shown in FIG. 1, cam 102 is pushing against the right side of channel 104 and holding pin 106 in reference stop 108. Take-up spring 110 biases cam 102 so that it will force pin 106 into stop 108.

To move the developer away from the photoconductor, cam 102 is rotated 180°. In such a position, cam 102 will push the U-shaped channel 104 to the left. This translates the developer to the left and moves the developer away from the photoconductor 16. Take-up spring 110 is not effective in this position, since it is stopped by nut 112. There is no necessity for holding pressure to position the developer frame to the left.

While the details of mounting the developer, magnetic brush 10 and levers for moving the magnets within brush 10 and for opening the purge door 56 have been shown, it will be appreciated by one skilled in the art that any number of mechanisms might be utilized to implement the invention. One skilled in the art will also appreciate that there might be any number of ways to deactivate the flow of toner onto magnetic brush 10 and thus divert it out through an opening in the developer and thereby purge the developer. Thus, while I have illustrated and described the preferred embodiment of my invention, it is understood that I do not limit myself to the precise constructions herein disclosed, and the right is reserved to all changes and modifications coming within the scope of the invention as defined in the appended claims.

What is claimed is:

1. In a magnetic brush developer having a magnetic brush roller, means for generating a brush magnetic field from within said brush roller, a magnetic transport roller and means for generating a transport magnetic field from within said transfer roller, said brush roller and said transport roller positioned so that the pick-up zone of the brush magnetic field is in the throw-off zone of said transport magnetic field, improved apparatus for purging the developer mix from the developer, said improvement comprising:

a purge opening located adjacent the juncture of the throw-off zone of said transport roller and the pick-up zone of said brush roller, said opening covered by a purge door;

said brush field generating means being moveable between a develop position and a purge position; in the develop position, said pick-up zone is in said throw-off zone, and in the purge position, said pick-up zone is outside of said throw-off zone;

means for moving said brush field generating means from the develop position to the purge position;

a catching means attached to said developer at said purge opening for catching the developer mix;

means for opening said purge door so that when said door is open and said brush magnetic field means is in the purge position, the developer mix flows from said throw-off zone out the purge opening and into said catching means.

2. The apparatus of claim 1 wherein:

said transport roller is located at the bottom of the developer adjacent a mixing chamber, the throw-off zone of said transport roller being located at the top of said transport roller;

said brush roller is located immediately above said transport roller, the pick-up zone for said brush roller is at the bottom of the brush roller adjacent the throw-off zone of said transport roller;

said purge opening is aligned with the natural flow of developer mix as the mix leaves the throw-off zone of said transport roller when the mix is not picked up by said brush roller.

3. The apparatus of claim 2 wherein said moving means comprises:

a rotatable shaft for carrying said brush field generating means;

lever means attached to said rotatable shaft for rotating said brush field generating means between the develop position and the purge position, each of said positions being defined by a detent for said lever means.

4. The apparatus of claim 3 wherein said opening means comprises:

a second rotatable shaft for carrying said purge door;

second lever means attached to said second rotatable shaft for rotating said purge door between the closed position and the open position, each of the closed and open positions being defined by a detent for said second lever means.

5. Method for purging the developer mix from a xerographic developer having a magnetic brush and a transport for transporting developer mix from a mixing chamber to the throw-off zone of the transport adjacent the pick-up zone of the brush, said method comprising the steps of:

attaching a catching container to the developer at a purge opening in the developer located adjacent said throw-off zone;

opening a purge door to uncover the purge opening;

moving the pick-up zone of the magnetic brush out of the throw-off zone of the transport;

operating the developer whereby the developer mix circulates through the developer to the transport and is thrown from the throw-off zone of the transport, out the purge opening and into the catching container.

6. The method of claim 5 wherein said brush is a roller having permanent magnets for generating the brush magnetic field, said magnets mounted within the roller on a rotatable shaft and said moving step comprises:

rotating said shaft and magnets mounted thereon to a position where the pick-up zone of the magnetic field of the brush roller is out of the throw-off zone of the transport.

7. The method of claim 6 wherein said transport is a roller having permanent magnets mounted within the roller for producing a magnetic field so that, as the roller rotates, developer mix is transported from the mixing chamber to said brush roller.

8. The method of claim 7 wherein said purge door is mounted on a rotatable shaft and said opening step comprises:

rotating the shaft with the door mounted thereon so that the door swings open and uncovers the purge opening the developer.

* * * * *